US005562401A

United States Patent [19]

Drew et al.

[11] Patent Number: 5,562,401

[45] Date of Patent: Oct. 8, 1996

[54] FORMS TILT CART WITH CAM ACTION LOCK

[75] Inventors: Wilbur Drew, Dover; John E. Lord, Milton, both of N.H.

[73] Assignee: Moore Business Forms, Inc., Grand Island, N.Y.

[21] Appl. No.: 398,597

[22] Filed: Mar. 3, 1995

[51] Int. Cl.[6] ..... B65H 31/00

[52] U.S. Cl. ..... 414/778; 211/170; 292/163; 271/149

[58] Field of Search ..... 211/131, 170; 292/163, 170, 175; 493/410, 416; 271/149, 150, 151; 414/788, 778

[56] References Cited

U.S. PATENT DOCUMENTS 1,946,384 2/1934 Baril et al. ..... 292/163 X 5,061,233 10/1991 Schultz et al. ..... 493/410

FOREIGN PATENT DOCUMENTS 2240684 2/1974 Germany .

*Primary Examiner*—Karen B. Merritt
*Assistant Examiner*—Janice L. Krizek
*Attorney, Agent, or Firm*—Nixon & Vanderhye

[57] ABSTRACT

The cart includes a cart body tiltable relative to a base mounted on casters. A locking device for maintaining the cart body in selected tilted position relative to the base includes an actuator having a cam surface and a pin biased into a locking position by a spring having a cam follower surface. By displacing the actuator, the cam displaces the pin from an opening in a locking plate carried by the cart body to enable tilting movement of the cart body relative to the base. By displacing the actuator in the opposite direction, the bias of the spring moves the pin into an opening in the locking plate, locking the cart body in a selected angular position relative to the base.

12 Claims, 3 Drawing Sheets

FORMS TILT CART WITH CAM ACTION LOCK

TECHNICAL FIELD

The present invention relates to a cart for containing compacted fanfolded business forms on edge and particularly relates to a cart having a body tiltable relative to a cart base into selected tilted positions in combination with a locking device having a readily accessible remotely actuated handle for facilitating locking and unlocking of the cart relative to the base.

BACKGROUND

A tiltable cart for compacting fanfolded business forms by causing them to stand on edge is described and illustrated in U.S. Pat. No. 5,061,233, of common assignee herewith, the disclosure of which is incorporated herein by reference. In that patent, there is disclosed a tiltable cart having a movable forms backstop extending upwardly from a main surface of the cart against which forms, received from a folding machine, are compacted. The cart includes a plurality of belts movable along the main surface and engaging the lower edges of the forms such that the forms may be compacted against the backstop. As the forms are driven onto the cart, the backstop is also driven in a direction away from a delivery table coupled to the form folding machine to drive the belts along the main surface of the cart whereby the forms are compacted and disposed on the cart main surface on edge. When the cart is full of the forms, the last form is detached from forms on the delivery table and the cart may be wheeled to another location and disposed in operative association with another forms utilization device.

For certain forms utilization devices, the cart body is tilted on end or at a predetermined angle relative to its base so that the folded forms do not curl at their edges and also to facilitate their withdrawal from the cart. It will be appreciated that the cart when filled with business forms is fairly heavy and, as pointed out in U.S. Pat. No. 5,061,233, hydraulic shock absorbers are provided to damp movement of the cart body.

The cart as disclosed in the above-discussed patent is maintained in a tilted position by a detent mechanism, including a locking plate carried by the cart body having a plurality of holes, a detent shaft having a knob at its outer end, and a spring mechanism for spring-loading the shaft. Thus, the shaft is biased into contact with the plate so that the shaft will enter one of the holes in the plate and hence maintain the cart body in a predetermined tilted position. It has been discovered, however, that it remains relatively difficult to manipulate the cart body, i.e., to tilt the cart body when loaded with business forms, while simultaneously maintaining the spring-biased shaft out of locked position with the openings in the locking plate. That is, the knob 82 must be pulled and held out of position in order to tilt the cart into the desired position. Because the operator has only a single hand to manipulate the cart, the operator may lose control of the cart body due to the weight of the forms in the cart, while attempting to both tilt the cart body and maintain the knob out of contact with the locking plate.

DISCLOSURE OF THE INVENTION

In accordance with the present invention, the tiltable cart body is provided with an actuator and a locking device for locking and unlocking the tilt cart body relative to the base in a manner which maintains the locking pin or shaft in an unlocked position to enable manipulation of the cart body into the selected angular position prior to locking. Particularly, the present invention provides a cam-actuated lever which is wedge-shaped and slidable in a guide track mounted on the base of the cart. The lever has an elongated slot along its cam surface for receiving the locking shaft or pin. The shaft as in the prior patent is spring-biased towards a locked position. By displacing the actuator linearly within the guide track, the cam surface engages a following surface on the pin to move the pin from its locked position into an unlocked position. The actuator maintains the pin in the unlocked position against the bias of the spring. When the cart body has been tilted to the selected position, the actuator may be withdrawn, enabling the spring-biased pin or shaft to return to its locking position, locking the cart body to the base in the selected angular position.

In a preferred embodiment according to the present invention, there is provided a tiltable cart for receiving a plurality of business forms in a compacted configuration, comprising a cart body having a main surface for supporting compacted forms thereon and a base, including legs, for supporting the cart body and the forms thereon, a pivotal mounting pivotally coupling the cart body and the base to one another for tilting the cart body into selected tilted positions relative to the base, a locking device for locking the cart body in a selected tilted position relative to the base including a member movable between locked and unlocked positions, the member being biased for movement into the locked position, an actuator for moving the member against the bias from the locked position into the unlocked position in response to displacement of the actuator from a first position to a second position, the actuator enabling movement of the member from the unlocked position to the locked position in response to displacement of the actuator from the second position to the first position, the actuator having a handle remote from the movable member for displacing the actuator.

In a further preferred embodiment according to the present invention, there is provided a tiltable cart for receiving a plurality of business forms in a compacted configuration, comprising a cart body having a main surface for supporting compacted forms thereon and a base for supporting the cart body and the forms thereon, a pivotal mounting pivotally coupling the cart body and the base to one another for tilting the cart body into selected tilted positions relative to the base, a locking device for locking the cart body in a selected tilted position relative to the base including a member movable between locked and unlocked positions, the member being biased for movement into the locked position, an actuator for moving the member against the bias from the locked position into the unlocked position in response to displacement of the actuator from a first position to a second position, the actuator enabling movement of the member from the unlocked position to the locked position in response to displacement of the actuator from the second position to the first position, the actuator in the second position maintaining the member in the unlocked position against the bias of the movable member.

Accordingly, it is a primary object of the present invention to provide a novel and improved tilt cart body for compacting business forms, including a readily accessible and easily usable locking device for locking and unlocking the cart body in selected angular positions whereby the danger of overturning the cart is minimized or eliminated.

BEST MODE FOR CARRYING OUT THE INVENTION

Figure 1:
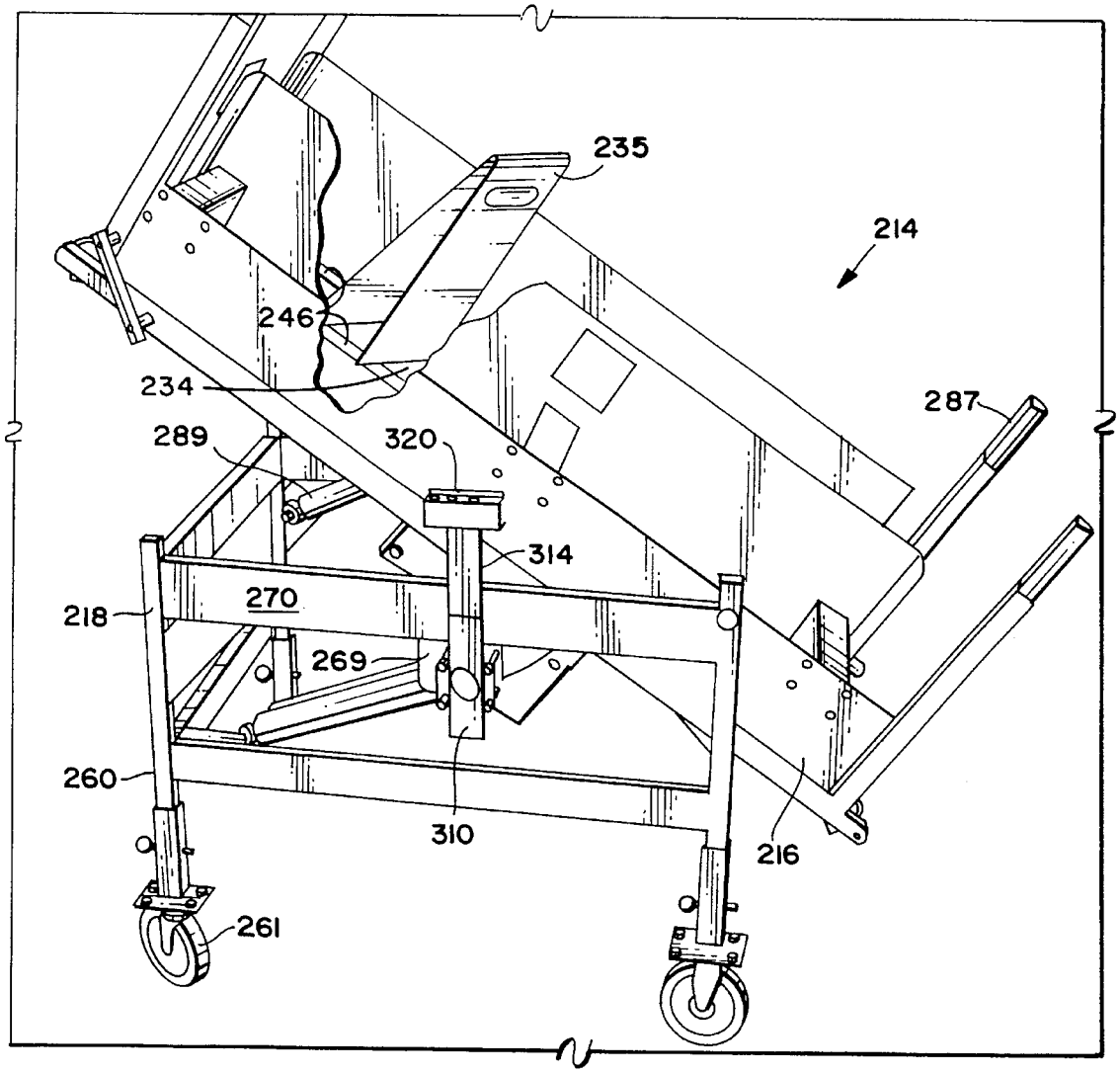
FIG. 1 is a perspective view of a tiltable cart for business forms constructed in accordance with the present invention.

Referring now to the drawings, particularly to FIG. 1, there is illustrated a movable cart, generally designated 214, for juxtaposition with a folding machine such as a fanfolder sold by Moore Business Forms, Inc., of Glenview, Ill. under the designation "8700 Folder" or "8800 Folder." The fanfolder delivers the fanfolded forms along a conveyor to a transfer conveyor. Ribbed belts on the transfer conveyor drive the business forms at a slower speed than the conveyor associated with the delivery table such that the forms are caused to be elevated to stand on edge and assume a generally vertical orientation. It will be appreciated that the cart 214 illustrated in FIG. 1 includes a cart body 216 pivotable relative to a base 218. The cart body 216 is illustrated in a tilted configuration. However, it will be appreciated that when the forms are received in the cart from the fanfolder, the cart typically lies horizontally relative to the base 218. The cart includes a main surface 234 which, together with belts 246, receive the folded forms. A forms backstop 235 moves along the main surface 234, facilitating the forms-compacting operation. Backstop 235 functions to raise up the leading forms from the fanfolder, folding the forms at the desired angle. Generally, the backstop 235 has a sloping front and an upstanding rear portion meeting at an apex. The backstop 235 is slidably mounted along the main surface 234 of the cart body 216. The lugged belts 246 having upstanding lugs or ribs are movable by the fanfolded forms along the main surface of the cart body 216. Thus, as the forms are driven onto cart 216, the backstop 235 will drive the belts 246 to maintain the forms in an upright position on the cart. Various other features of the cart body are described and illustrated in U.S. Pat. No. 5,061,233, which is incorporated herein by reference and can be referred to for those features.

The base 218 of the cart 214 includes a plurality of legs 260 for supporting the cart body 216. Casters or rollers 261 are provided at the lower ends of the legs 260 to facilitate rolling movement of the cart.

Figure 2:
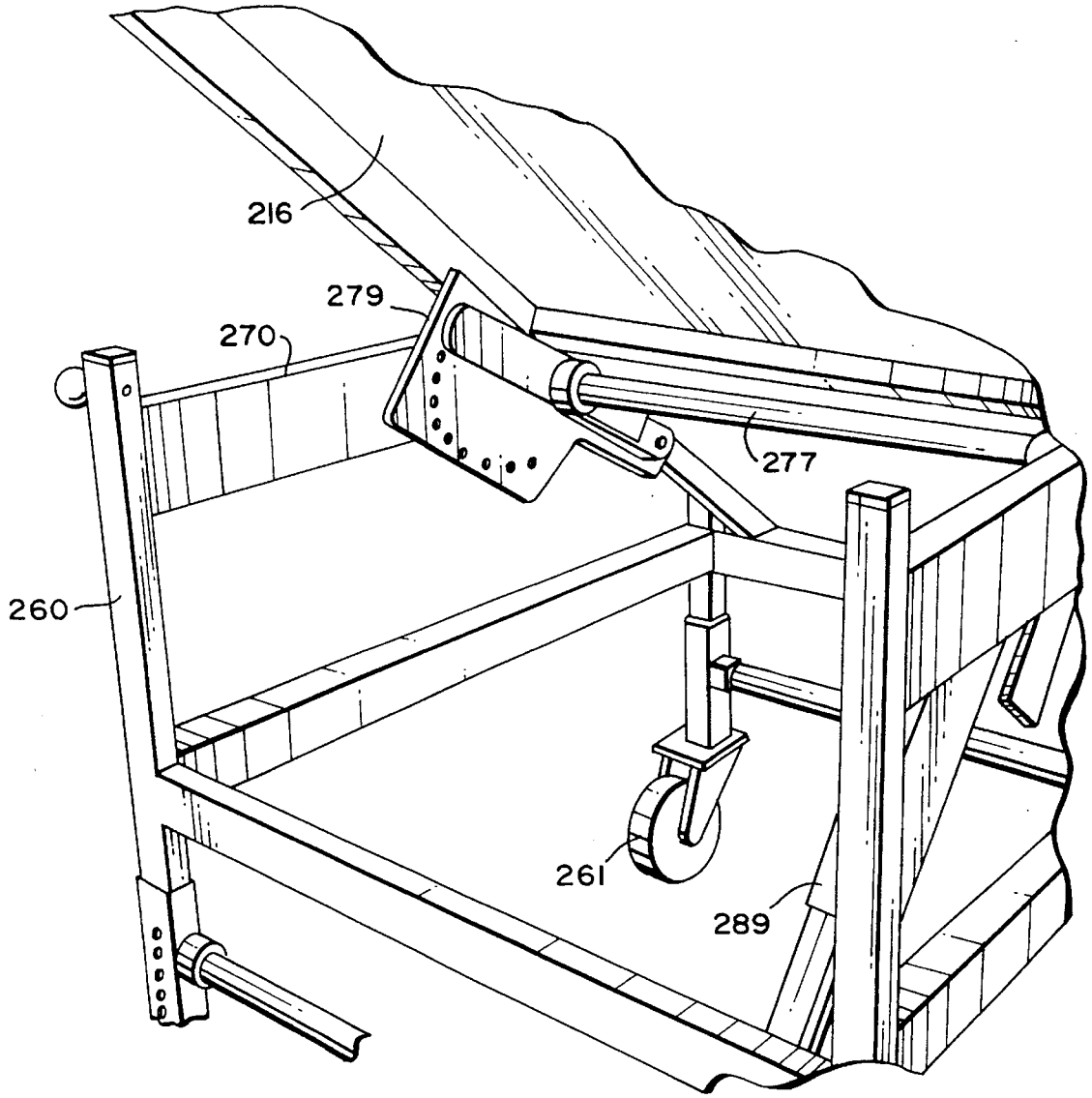
FIG. 2 is perspective view along the underside of the cart body and illustrating a portion of the mechanism for locking the body in position.
Figure 3:
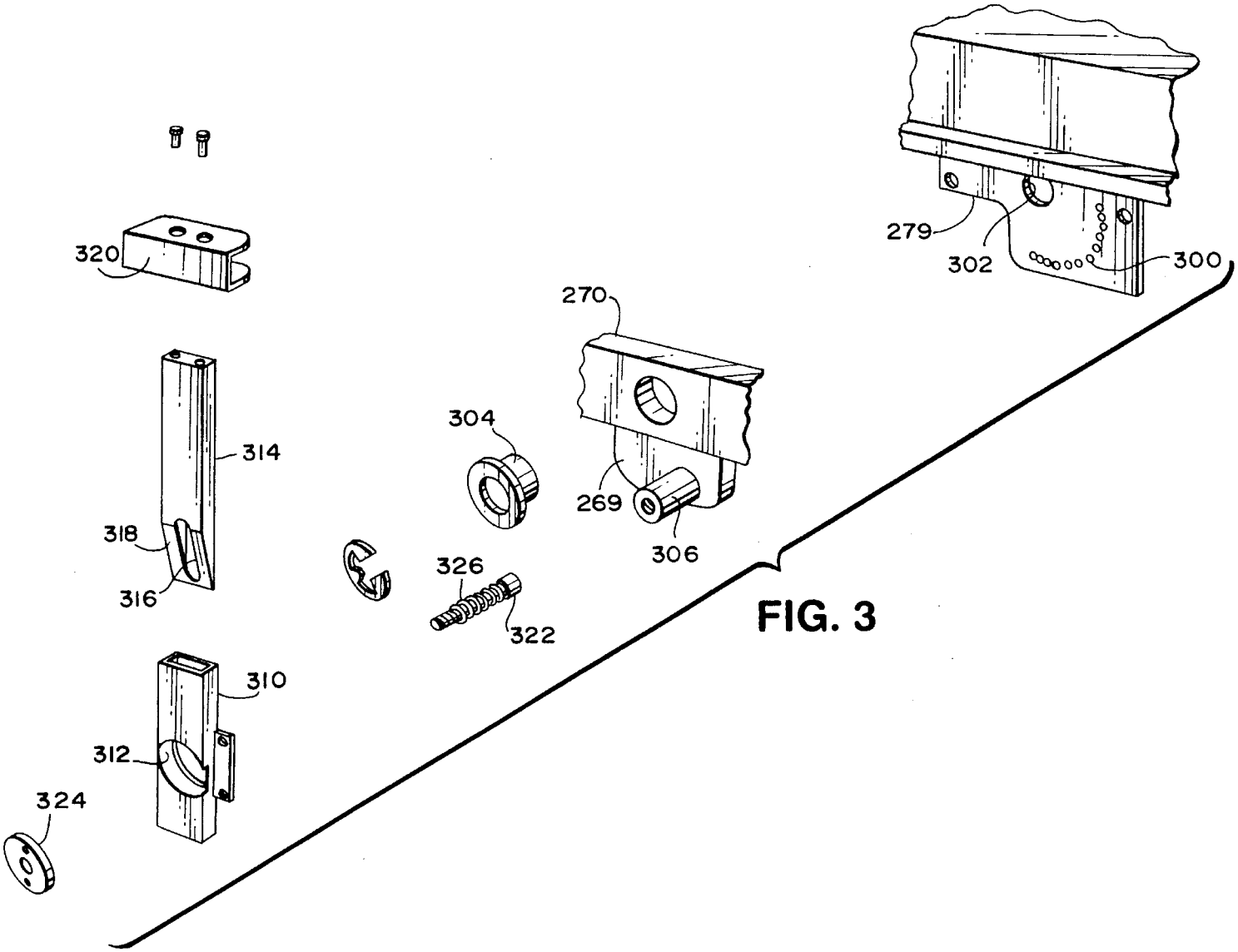
FIG. 3 is an exploded perspective view illustrating a locking device for locking the cart body in selected angular positions relative to the cart base.

In FIGS. 1 and 2, the cart body 216 is illustrated as tilted into an inclined position relative to the base 218. A pivotal mounting of the cart body 216 relative to the base 218 is effected. The pivotal mounting includes a steel shaft 277 (FIG. 2) which is journalled in opposite depending flanges 269 (FIG. 3) of cart base side frames 270 of base 218 and defines a horizontal axis.

Referring to FIGS. 1 and 2, tilting of the cart body 216 is effected by an operator manually grasping one or both of the handles 287 and rotating the cart body about the shaft 77. Because the cart is fairly heavy, especially when loaded, the tilting movement of the cart body may be damped. For that purpose, a pair of hydraulic shock absorbers 289 are provided. An end of each shock absorber is attached to a leg of the base, while the opposite end is secured to an arm, not shown, which extends downwardly from the shaft 277. Cylinders 289 are effective to damp any pivotal movement of the cart body about the shaft 277.

The cart body 216 is maintained in a selected angular position relative to the base 218 by a detent mechanism. Particularly, and referring to FIG. 3, the detent mechanism includes a plate 279 depending from a side frame of the cart body and having a plurality of openings 300 spaced one from the other about the axis of shaft 277 passing through the opening 302 in plate 279. As will be appreciated, the shaft 277, not shown in FIG. 3, passes through the opening 302 and through the side 270 of the base 218 and through a journal 304 secured to the base. The depending bracket mounts a stub shaft 306 having an axis parallel to the axis of rotation of shaft 277 and in alignment with the openings 300 such that, upon tilting the cart body, the holes 300 may register with the opening through the stub shaft 306.

Along the outside of the base 218, there is provided a generally rectilinear guide track 310. The guide track is essentially a rectangular tube secured to the side of the base and extending in a vertical direction. An opening 312 is disposed through the tube. Slidably received within the tube 310 is a cam 314. Cam 314 comprises a rectilinear metal bar having a through elongated slot 316 in its lower end. The lower end along the outer surface is also tapered at 318 to form a wedge or cam surface. A handle 320 is suitably secured to the upper end of the actuator 314. It will be appreciated that by disposing the actuator 314 in the guide tube 310, the slot 316 may be aligned with the opening 312.

A pin 322 is received in the stub shaft 306 and extends through the slot 316 of actuator 314 and the opening 312 of guide track 31 0, terminating at its outer end in a cam disk 324. A spring 326 is disposed about the pin 322 and bears at one end against a head on the pin which is receivable in a selected one of the openings 300. The opposite end of the pin 322 is screwthreaded to the disk 324. The inside face of the disk 324 may be complementary in shape to the cam surface 318 and serves as a cam follower for the actuator 314.

It will be appreciated that when the cart body is in a horizontal position relative to the base, the pin 322 is spring biased into one of the openings 300 and thus maintains the cart body in the horizontal position. When the operator desires to tilt the cart body relative to the base, the operator pushes down on the handle 320 to displace actuator 314 in a vertically downward direction. The wedge-shaped cam surface 318 engages the cam follower surface on the rear side of disk 324 thus moving the pin 322 laterally outwardly from engagement within the opening 300, releasing the cart body for tilting movement. The actuator 314 in its displaced position maintains the pin in its unlocked position. The operator is then free to tilt the cart body to the selected angle. When that angle is obtained, the operator raises the handle 320, displacing the actuator 314 upwardly and enabling the bias of spring 326 to move the member 322 to engage an opening 300 in registration therewith, thereby locking the cart body in the selected tilted position relative to the base. When the operator wishes to return the tilted cart body to a horizontal position or another tilted position, the operator pushes down on handle 320 to cam the pin 322 out of the opening 300, releasing the cart body for tilting movement in either direction. When the new position of the cart body is obtained, the handle is raised, enabling the spring to move the member 322 into the opening 300 to again lock the body in a predetermined position relative to the base.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A tiltable cart for receiving a plurality of business forms in a compacted configuration, comprising:

a cart body having a main surface for supporting compacted forms thereon and a base, including legs, for supporting said cart body and the forms thereon;

a pivotal mounting pivotally coupling said cart body and said base to one another for tilting said cart body into selected tilted positions relative to said base;

a locking device for locking said cart body in a selected tilted position relative to said base including a member movable between locked and unlocked positions, said member being biased for movement into said locked position;

an actuator for moving said member against said bias from said locked position into said unlocked position in response to displacement of said actuator from a first position to a second position, said actuator enabling movement of said member from said unlocked position to said locked position in response to displacement of said actuator from said second position to said first position; and said actuator having a handle remote from said movable member for displacing said actuator;

said member being movable between said locked and unlocked positions in directions parallel to an axis about which said cart body is tilted, said actuator being displaceable in a direction generally normal to said axis.

2. A tiltable cart for receiving a plurality of business forms in a compacted configuration, comprising:

a cart body having a main surface for supporting compacted forms thereon and a base, including legs, for supporting said cart body and the forms thereon;

a pivotal mounting pivotally coupling said cart body and said base to one another for tilting said cart body into selected tilted positions relative to said base;

a locking device for locking said cart body in a selected tilted position relative to said base including a member movable between locked and unlocked positions, said member being biased for movement into said locked position;

an actuator for moving said member against said bias from said locked position into said unlocked position in response to displacement of said actuator from a first position to a second position, said actuator enabling movement of said member from said unlocked position to said locked position in response to displacement of said actuator from said second position to said first position;

said actuator having a handle remote from said movable member for displacing said actuator; and said actuator including a cam having a cam surface, said member having a cam follower engageable with said cam surface.

3. A tiltable cart according to claim 2 wherein said member is movable between said locked and unlocked positions in directions parallel to an axis about which said cart body is tilted, said actuator being displaceable in a direction generally normal to said axis, said cam surface including a surface angled relative to said normal direction.

4. A tiltable cart for receiving a plurality of business forms in a compacted configuration, comprising:

a cart body having a main surface for supporting compacted forms thereon and a base, including legs, for supporting said cart body and the forms thereon;

a pivotal mounting pivotally coupling said cart body and said base to one another for tilting said cart body into selected tilted positions relative to said base;

a locking device for locking said cart body in a selected tilted position relative to said base including a member movable between locked and unlocked positions, said member being biased for movement into said locked position;

an actuator for moving said member against said bias from said locked position into said unlocked position in response to displacement of said actuator from a first position to a second position, said actuator enabling movement of said member from said unlocked position to said locked position in response to displacement of said actuator from said second position to said first position;

said actuator having a handle remote from said movable member for displacing said actuator;

said locking device including a guide fixed on said base and having an aperture for receiving said member within said guide, said actuator being slidably received in said guide for displacement of the actuator in a direction normal to the direction of movement of said member to move said member.

5. A tiltable cart according to claim 4 wherein said actuator includes a cam having a camming surface inclined to the direction of displacement of said actuator and having a slot through said camming surface for receiving said member.

6. A tiltable cart according to claim 4 wherein said cart body includes a plate tiltable therewith and having a plurality of openings through said plate, said member comprising a pin movable into a selected opening to lock said cart body and said base in a selected tilted position of said cart body relative to said base.

7. A tiltable cart for receiving a plurality of business forms in a compacted configuration, comprising:

a cart body having a main surface for supporting compacted forms thereon and a base for supporting said cart body and the forms thereon;

a pivotal mounting pivotally coupling said cart body and said base to one another for tilting said cart body into selected tilted positions relative to said base;

a locking device for locking said cart body in a selected tilted position relative to said base including a member movable between locked and unlocked positions, said member being biased for movement into said locked position;

an actuator for moving said member against said bias from said locked position into said unlocked position in response to displacement of said actuator from a first position to a second position, said actuator enabling movement of said member from said unlocked position to said locked position in response to displacement of said actuator from said second position to said first position, said actuator in said second position maintaining said member in said unlocked position against the bias of said movable member; and said member being movable between said locked and unlocked positions in directions parallel to an axis about which said cart body is tilted, said actuator being displaceable in a direction generally normal to said axis.

8. A tiltable cart for receiving a plurality of business forms in a compacted configuration, comprising:

a cart body having a main surface for supporting compacted forms thereon and a base for supporting said cart body and the forms thereon;

a pivotal mounting pivotally coupling said cart body and said base to one another for tilting said cart body into selected tilted positions relative to said base;

a locking device for locking said cart body in a selected tilted position relative to said base including a member movable between locked and unlocked positions, said member being biased for movement into said locked position;

an actuator for moving said member against said bias from said locked position into said unlocked position in response to displacement of said actuator from a first position to a second position, said actuator enabling movement of said member from said unlocked position to said locked position in response to displacement of said actuator from said second position to said first position, said actuator in said second position maintaining said member in said unlocked position against the bias of said movable member; and said actuator including a cam having a cam surface, said member having a cam follower engageable with said cam surface.

9. A tiltable cart according to claim 8 wherein said member is movable between said locked and unlocked positions in directions parallel to an axis about which said cart body is tilted, said actuator being displaceable in a direction generally normal thereto, said cam surface including a surface angled relative to said normal direction.

10. A tiltable cart according to claim 8 wherein said locking device includes a guide fixed on said base and having an aperture for receiving said member within said guide, said actuator being slidably received in said guide for displacement of the actuator in a direction normal to the direction of movement of said member to move said member.

11. A tiltable cart according to claim 10 wherein said actuator includes a cam having a camming surface inclined to the direction of displacement of said actuator and having a slot through said camming surface for receiving said member.

12. A tiltable cart according to claim 10 wherein said cart body includes a plate tiltable therewith and having a plurality of openings through said plate, said member comprising a pin movable into a selected opening to lock said cart body and said base in a selected tilted position of said cart body relative to said base.

* * * * *